United States Patent [19]

Malcom

[11] 4,295,245

[45] Oct. 20, 1981

[54] COMBINATION HINGE AND OVERCENTER CLOSURE FOR A DOOR

[76] Inventor: George E. Malcom, 55356 County Rd. 15 South, Elkhart, Ind. 46514

[21] Appl. No.: 102,985

[22] Filed: Dec. 12, 1979

Related U.S. Application Data

[63] Continuation of Ser. No. 929,857, Jul. 31, 1978, abandoned.

[51] Int. Cl.[3] ..... G05F 1/12; G05F 1/14

[52] U.S. Cl. ..... 16/80; 16/182

[58] Field of Search ..... 16/72, 78, 135, 182, 16/65, 80, 163 (U.S. only), 180

[56] References Cited

U.S. PATENT DOCUMENTS

| | | | |
|---|---|---|---|
| 2,244,949 | 6/1941 | Hutchinson | 16/65 X |
| 2,479,437 | 8/1949 | Vigmostad et al. | 16/135 |
| 2,908,032 | 10/1959 | Hatch | 16/80 |
| 3,287,757 | 11/1966 | Van Noord | 16/72 |
| 3,579,709 | 5/1971 | Pierie | 16/65 |
| 3,710,415 | 1/1973 | Wilson | 16/135 X |
| 3,771,194 | 11/1973 | Little | 16/85 X |
| 3,828,393 | 8/1974 | Pierie | 16/65 |
| 4,141,104 | 2/1979 | Watson | 16/65 |

*Primary Examiner*—Wm. Carter Reynolds
*Attorney, Agent, or Firm*—Oltsch, Knoblock & Hall

[57] ABSTRACT

A semi-concealed door hinge having leaf parts connected by a pintle. Each leaf part includes a connector plate which is attached to either the door or its supporting frame at the rear face thereof. These connector plates form a supporting part of the overcenter closure with the closure extending between leafs of the hinge.

2 Claims, 7 Drawing Figures

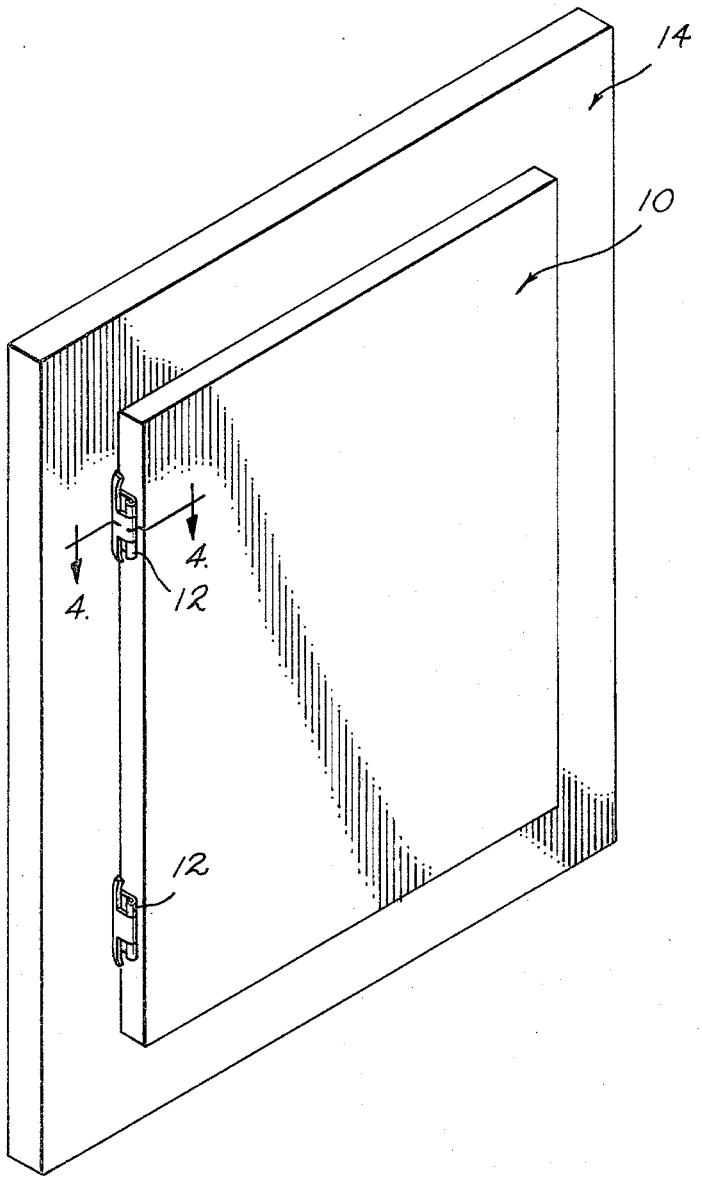
Fig. 1
Fig. 2
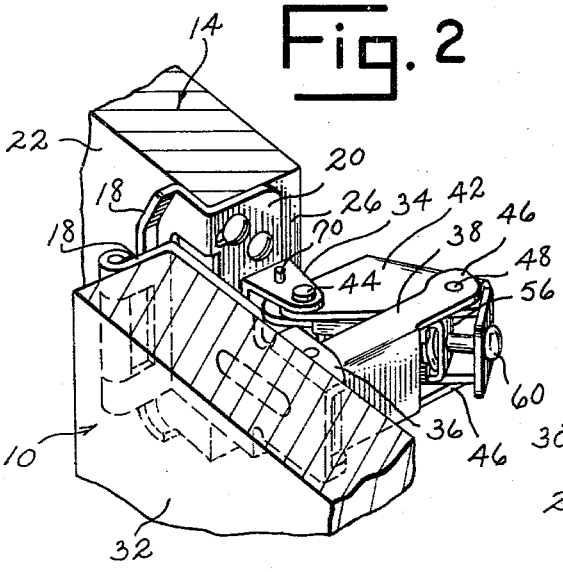
Fig. 3
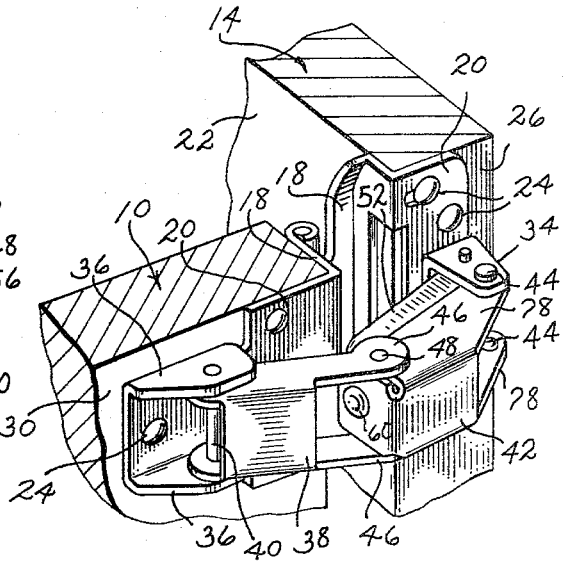

Fig. 4
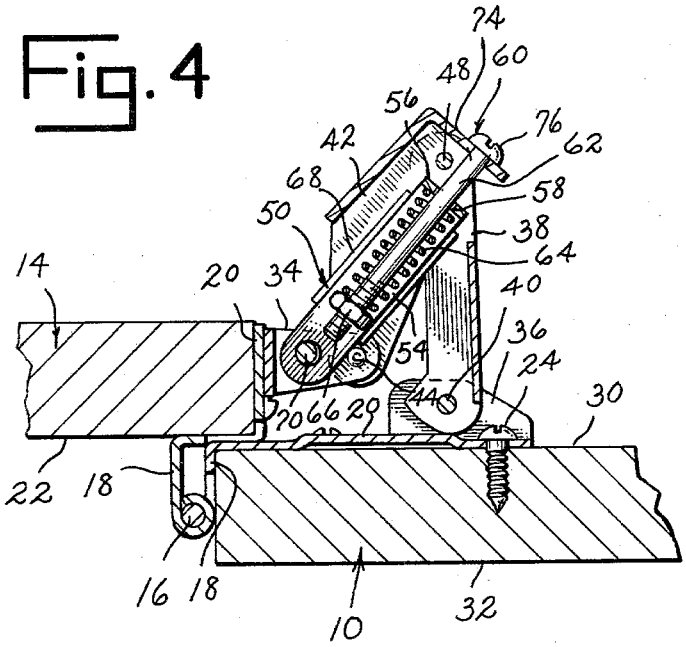
Fig. 5
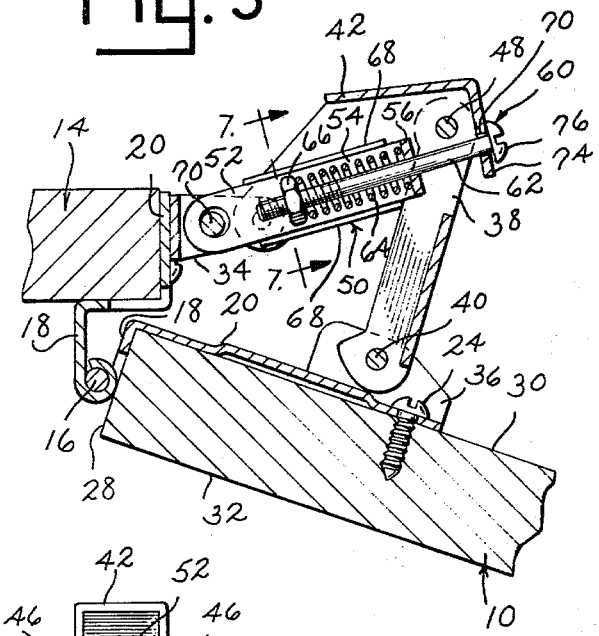
Fig. 6
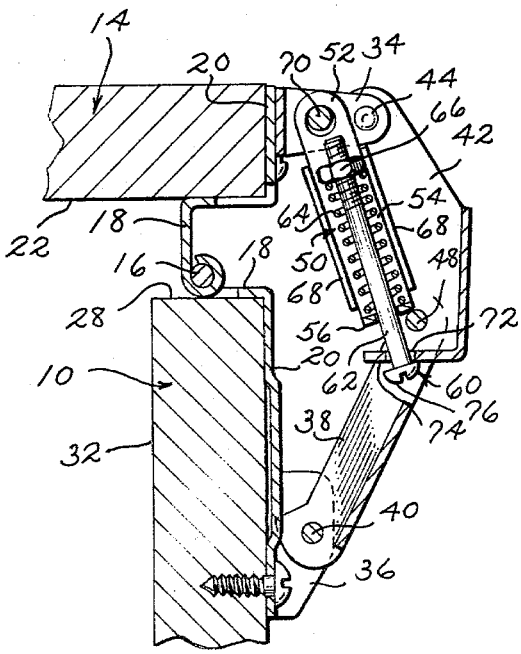
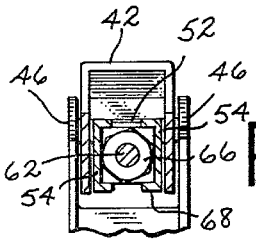
Fig. 7

COMBINATION HINGE AND OVERCENTER CLOSURE FOR A DOOR

This is a continuation of application Ser. No. 929,857, filed July 31, 1978 now abandoned.

BACKGROUND OF THE INVENTION

The hinge of this invention is used principally for cabinet and similar doors and is of the semi-concealed type in which only the pintle of the hinge is visible from the exterior of the door when in its closed position. An adjustable overcenter closure forms a part of the hinge and serves to bias the door into either open or closed positions.

U.S. Pat. No. 3,439,377 relates to a semi-concealed cabinet door hinge which does not incorporate the use of an overcenter closure. U.S. Pat. Nos. 3,673,635; 3,724,021; 3,772,736; and 3,828,393 pertain to overcenter type closures which are not in connected association with a semi-concealed hinge and which incorporate a plurality of parts greater in number than those utilized in the subject invention. A commercially available overcenter closure is sold under the tradename "EASYON". It consists of six linkage components and one extendible biasing component. Additionally, the subject invention utilizes an adjustment for regulating the spring tension which is not utilized in any of the aforementioned patents or prior art hinge construction.

SUMMARY OF THE INVENTION

In this invention a semi-concealed door hinge having leaf parts connected by a pintle is utilized. Each leaf part includes a connector plate which is attached to either the door or its supporting frame at the rear face thereof. These connector plates form a supporting part of the overcenter closure with the closure extending between leafs of the hinge. The spring biasing member which forms a part of the closure is adjustable by which the spring tension can be varied to regulate the closure force for the door.

Accordingly, it is an object of this invention to provide a door hinge which incorporates an overcenter closure.

Another purpose of this invention is to provide a door hinge having an adjustable overcenter closure connected thereto.

Other objects of this invention will become apparent upon a reading of the invention's description.

BRIEF DESCRIPTION OF THE DRAWINGS

A preferred embodiment of this invention has been chosen for purposes of illustration and description wherein:

FIG. 1 is a perspective view of a door connected to a frame by the combination hinge and closure of this invention.

FIG. 2 is a fragmentary enlarged view of the combination hinge and closure shown with the door of FIG. 1 in its closed position.

FIG. 3 is a fragmentary enlarged perspective view of the combination hinge and closure showing the door of FIG. 1 in a retained open position.

FIG. 4 is a fragmentary sectional view taken along line 4—4 of FIG. 1.

FIG. 5 is a sectional view like FIG. 4 but showing the door in an intermediate open position.

FIG. 6 is a fragmentary sectional view like FIG. 4 showing the door in its retained open position.

FIG. 7 is a fragmentary cross-sectional view taken along line 7—7 of FIG. 5.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

In FIG. 1 a door 10 is shown connected by two combination hinge and closures 12 to frame 14. Each combination hinge 12 includes a pair of leafs connected by a pintle or pivot pin 16. Each leaf of the combination hinge includes a leg 18 and a connector plate 20. The leg 18 of one leaf is of a right angular construction and is located at the front face 22 of frame 14 with attached connection plate 20 of the leaf being secured by suitable attachment screws 24 to the side face 26 of the frame. Another leaf of each combination hinge 12 extends along the side edge 28 of door 10 with its attached connector plate 20 secured by screws 24 to the rear face 30 of the door. Pintle 16 of combination hinge 12 is located along door side edge 28, forwardly of face 22 of frame 14 but slightly rearwardly spaced from the plane of front face 32 of the door.

A pair of spaced tabs or flanges 34 are secured to connector plate 20 over frame side face 26 of frame 14. Flanges 34 project normally from side face 26 and are positioned so as to be located behind rear face 30 of door 10 when the door is in its closed position. A pair of spaced tabs or flanges 36 are formed integrally with connector plate 20 which overlies rear face 30 of door 10. Flanges 36 project normally from door rear face 30. A channel-shaped link part 38 is pivotally connected at one end by pin 40 to flanges 36. Another link part 42, also channel-shaped, is pivotally connected by pins 44 to flanges 34. Link part 38 includes two arms 46 located at the opposite end of the link part from pin 40 and which straddle link part 42 at its opposite end from pins 44. A pin 48 pivotally connects arms 46 to link part 42.

The overcenter holding action for the combination hinge 12 is provided by an expander 50. Expander 50 includes a retainer bracket 52 which is U-shaped having sides 54 connected at one end by a transverse web 56. An opening 58 is formed in the center of web 56. A screw 60 or similar threaded member has its shank 62 extending through retainer bracket opening 58. A helical spring 64 is located between sides 54 of the retainer bracket and encircles screw shank 62 with one end abuting web 56. A nut 66 is turned onto the threaded end of shank 62 and brought to bear against the opposite end of spring 64. The longitudinal edges of retainer bracket sides 54 are formed into opposing flanges 68 with nut 66 fitting restrictively between sides 54 of the bracket to prevent rotation of the nut upon turning of the screw. Nut 66 is able to shift along screw 60 upon its turning.

Expander 50 is secured between flanges 34 and link part 42. Sides 54 of retainer bracket 52 are secured by a pin 70 at their opposite ends from web 56 to flanges 34 at a location spaced between connector plate 20 which carries the flanges and pivot pin 44. The axes of pins 40, 44 and 70 parallel the axis of pintle 16 of each combination hinge 12. An opening 72 is formed in end wall 74 of link 42. The shank 62 of screw 60 extends through opening 72 with head 76 of the screw abutting end wall 74 of link part 42 at its exterior face. With expander 50 so connected between flanges 34 and link part 42, retainer bracket 52 is located between the legs 78 of the link part.

When door 10 is in its closed position as shown in FIGS. 1, 2 and 4, the axial center line of expander 50 is located rearwardly of the axis of pivot pin 44 with spring 64 within retainer bracket 52 exerting an expandable force to create a pull upon screw 60 which serves to retain door 10 in its closed position. When door 10 is swung into its open position, expander 50 passes through the pivot axis of pin 44 as illustrated in FIG. 5 and into a position with its centerline located forwardly the axis of pin 44 as best shown in FIG. 6 in which spring 64 serves to create a pull upon screw 60 which retains door 10 in its open position shown in FIGS. 3 and 6. As expander 50 passes over pin 44 as illustrated in FIG. 5, screw 60 is pulled outwardly relative to retainer bracket 52 so as to compress spring 64.

The holding force of expander 50 can be varied by the turning of screw 60 which is slotted at its head 76 to accomodate a screwdriver. Rotation or turning of screw 60 will cause the expansion or compression of spring 64 which in turn will vary the force imposed by the spring upon the screw when the door is in its open or closed positions. This allows the hinge 12 to be adjusted for various sizes and type doors.

It is to be understood that the invention is not to be limited to the details above given but may be modified within the scope of the appended claims.

What I claim is:

1. In a combination hinge and overcenter retainer connecting a door having front and rear faces separated by a side edge to a frame having a front face and an adjoining side face wherein said hinge includes first and second legs mutually connected for pivotal movement and first and second connector plates, said first connector plate joined to said first leg, said second connector plate joined to said second leg, said first connector plate secured to the rear face of said door with said first leg extending along said door edge, said second connector plate secured to the side face of said frame with said second leg extending forwardly of said frame front face whereby said door is pivotal about said legs pivot connection for movement between open and closed positions, said overcenter retainer including a flange connected to each hinge connector plate, a first said flange projecting outwardly from said first connector plate at said frame side face, a second said flange projecting outwardly from said second connector plate at said door rear face, a first link pivotally connected at one end to said first flange and a second link pivotally connected at one end to said second flange, said links pivotally connected together at their respective opposite ends, expansion means pivotally connected between one of said flanges spaced from the pivot connection of the link thereto and such link next to its pivot connection to the other link, said expansion means for applying a yieldable biasing pull between said one flange and its connected link to urge said door into its closed and open positions upon manual movement of the door between said positions, the improvement wherein said expansion means includes a retainer and an adjustment member having a shank and a head, one end of said retainer pivotally connected to said one flange at a location spaced from the pivot connection of its connected link, the opposite end of said retainer receiving in sliding cooperation the shank of said adjustment member with the adjustment member head located exteriorly of the retainer, spring means extending between said retainer and said adjustment member shank in compression for causing said adjustment member head to be yieldably drawn toward said retainer, said adjustment member secured at its head to said one flange connected link adjacent its pivot connection to said other link, said adjustment member shank including means associated with said spring means for varying the compression of the spring means upon rotation of said adjustment member shank whereby the force exerted by said expansion means upon said door in its open and closed positions can be varied.

2. The combination hinge and overcenter retainer of claim 1 wherein said retainer opposite end has an opening therein through which said adjustment member shank extends, said spring means constituting a helical spring encircling said adjustment member shank with one end abutting said retainer opposite end, said adjustment member shank being threaded and including a nut turned thereupon in abutment with the other end of said spring, said nut constituting said means for varying the compression of the spring means, means retaining said nut against rotation relative to said retainer while allowing movement of the nut towards and away from said adjustment member head upon rotation of the adjustment member shank, said adjustment member head including means externally accessible for rotation said adjustment member shank.

* * * * *